US006056588A

United States Patent [19]

Castaldo

[11] Patent Number: 6,056,588

[45] Date of Patent: May 2, 2000

[54] STRAIN-RELIEF SYSTEM FOR A FOLDING PLUG AND CONNECTOR SYSTEM

[75] Inventor: Cosmo Castaldo, Westbury, N.Y.

[73] Assignee: Leviton Manufacturing Co., Inc., Little Neck, N.Y.

[21] Appl. No.: 09/406,572

[22] Filed: Sep. 24, 1999

Related U.S. Application Data

[63] Continuation of application No. 09/314,711, May 19, 1999, Pat. No. 5,975,941, which is a continuation of application No. 08/921,637, Aug. 27, 1997, Pat. No. 5,934,931.

[51] Int. Cl.[7] ..... H01R 13/58

[52] U.S. Cl. ..... 439/469

[58] Field of Search ..... 439/467, 469, 439/472

[56] References Cited

U.S. PATENT DOCUMENTS 3,856,376 12/1974 Poliak et al. ..... 339/107

4,191,444 3/1980 Smith et al. ..... 339/107

*Primary Examiner*—Michael L. Gellner
*Assistant Examiner*—Antoine Ngandjui
*Attorney, Agent, or Firm*—Paul J. Sutton

[57] ABSTRACT

This invention relates to an electrical connector for attachment to the end of an electrical cable. The connector includes a split body having contacts supported thereon for attachment to conductors of the cable. The split body accommodates cables of different diameters and is provided with a cable clamping member which can be placed in either of the split body portions. This cable clamping member cooperates with a clamping jaw on the other body member to clamp the cable between the cable clamping member and clamping jaw to provide strain-relief when the two body parts are joined. The cable clamping member is fitted with various ribs, tabs, etc. to properly position the cable clamping member in the body portions.

3 Claims, 7 Drawing Sheets

STRAIN-RELIEF SYSTEM FOR A FOLDING PLUG AND CONNECTOR SYSTEM

This is a continuation of application Ser. No. 09/314,711 filed on May 19, 1999, now U.S. Pat. No. 5,975,941 which is a continuation of application Ser. No. 08/921,637 filed on Aug. 27, 1997 and now U.S. Pat. No. 5,934,931.

BACKGROUND OF THE INVENTION

1. Field of the Invention

The invention deals with electrical connectors for terminating electrical cables and more particularly to a strain-relief device used with electrical connectors to prevent forces applied to the electrical cable effecting the connector or the connections made therein.

2. Description of the Prior Art

A common way of providing strain relief to connectors, according to the prior art, made use of a screw-operated cable clamp external to the connector but coupled to it. The screws could be tightened to any level from where the clamp barely engaged the cable to so tight that the clamp cut into the cable insulation and distorted the cable.

In U.S. Pat. No. 3,856,376 issued Dec. 24, 1974 and now expired, a removable cable gripping member cooperated with ribs on the interior of the connector body to provide strain relief. The cable gripping member could be placed in one of its two orientations to accommodate two groups of cable ranges. Cables beyond these ranges cannot be accepted.

Another approach is to provide tabs in each of the two parts of a split body connector. The strain relief is applied to the cable when the two parts of the body are fastened to each other and the tabs engage opposite sides of the cable. The spacing between the confronting edges of the tabs set the range of cable diameters which could be employed with the connectors.

The tabs molded as a part of the connector, could be replaced by separate tabs. The length of the tabs could then be chosen so as to accept a range of cable diameters. These additional parts could be easily lost if the connector was opened and the cable removed.

A strain relief boot could be molded at the cable end with a series of grooves, at least one of which, is gripped by cooperating jaws at the connector end. If the cable has to be cut to make repairs, the strain-relief is eliminated.

Strain-reliefs may also be molded over the cable and connector end. Such strain-relief must be removed to replace the connector and leaves the connector/cable combination without any strain relief.

SUMMARY OF THE INVENTION

The strain-relief system of the instant invention overcomes the deficiencies of the known prior art by providing an easily installed, easily used strain-relief device. A split housing having two mateable body portions is arranged to receive the end of an electrical cable between them and hold such cable in the housing when the two mateable portions are fastened to one another. The connector within the housing has its contacts extend from the front end of the housing while an electrical cable entrance extends through the second end. A molded cable clamping tab is formed on each of said two body portions adjacent the cable entrance and each partially block such entrance. By contouring the free ends of the clamping tabs, a wide range of cable diameters can be accommodated. A removable clamp insert is placed in one of the body portions over the clamping tab of that body portion. The position of the clamp insert is determined by slots in the body portion and by the cable entrance. The clamp insert has two ridges transverse to the longitudinal axis of the housing and receives the clamping tab of the other body portion between such ridges. An electrical cable is caused to follow a circuitous route over a first transverse ridge, under the associated clamping tab and over the second transverse ridge into the interior of the housing. A recess between the transverse ridges receives part of the electrical cable when the two body portions are fastened together. It is an object of this invention to provide a novel strain-relief system for electrical connectors.

It is an object of this invention to provide a novel strain-relief system for electrical connectors having two mateable housing portions thereabout.

It is yet another object of this invention to provide a novel strain-relief system for electrical connectors having two mateable housing portions thereabout employing a removable clamp insert which can be placed in either of such two mateable housing portions.

It is still another object of this invention of provide a novel strain-relief system for electrical connectors having two mateable housing portions thereabout employing a strain-relief clamping tab formed on each of the two mateable housing portions and a removable clamp insert which can be placed in either of such two mateable housing portions to cooperate with the clamping tab of the other mateable housing portions to provide a circuitous route for an electrical cable introduced between said two mateable housing portions.

Other objects and features of the invention will be pointed out in the following description and claims and illustrated in the accompanying drawings, which disclose, by way of example, the principles of the invention, and the best mode presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
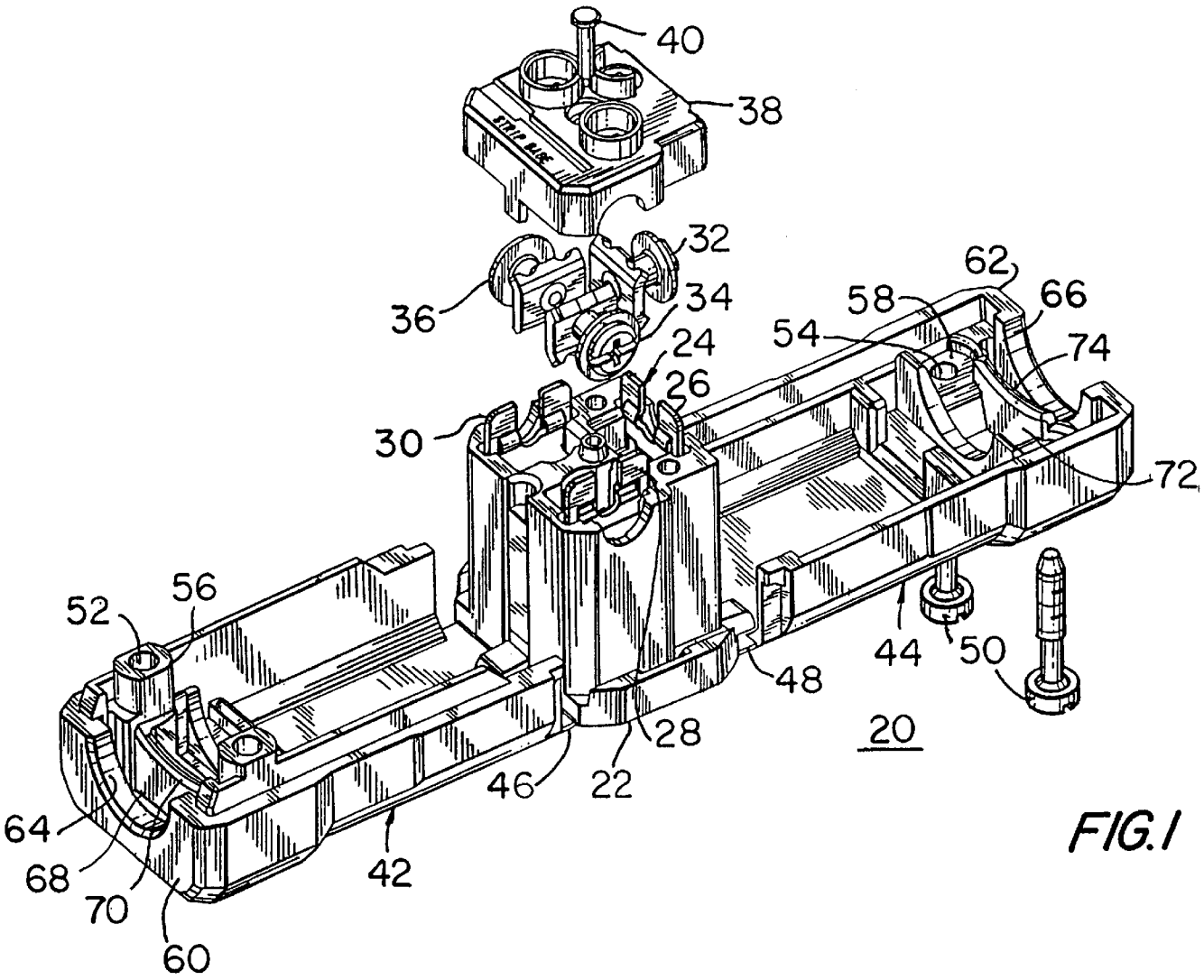
FIG. 1 is a perspective view of an electrical connector having a split body and incorporating one portion of the strain-relief system of the instant invention.
Figure 1A:
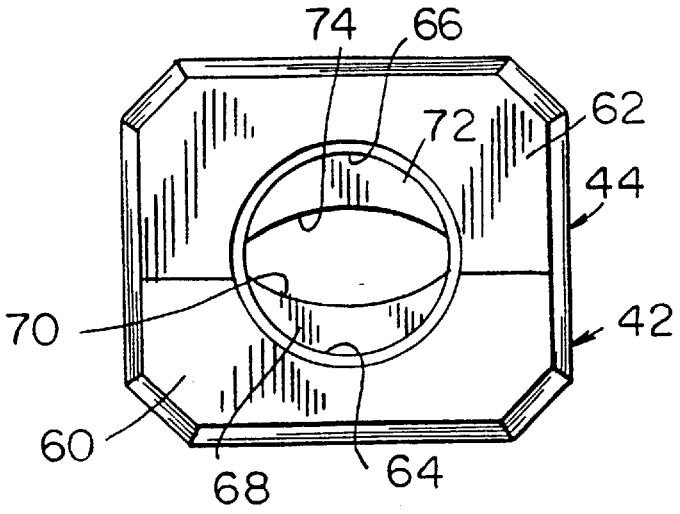
FIG. 1A is a rear elevational view of the connector of FIG. 1 in its assembled state.

Turning now to FIGS. 1, 1A, 2 and 3, there is shown an electrical connector assembly 20 which incorporates a portion of the strain-relief device 21 described herein. A central portion 22 houses the electrical connector device 24 made Up of contact assemblies 26, 28 and 30. The form of the electrical connector device 24 is that of a three prong plug with two flat blades and a ground pin projecting from the underside of a central portion 22 (not shown). Each of the contact assemblies 26, 28, 30 has a screw operated conductor contact 32, 34, 36, respectively. The bared ends of the phase, neutral and ground conductors of an electrical cable (not shown) are attached via the conductor contacts 32, 34 and 36 to the plug blades and ground pin. A cover 38 insulates the contact assemblies 26, 28 and 30 and the screw operated conductor contacts 32, 34 and 36. A threaded fastener 40 secures the cover 38 to the central portion 22.

Extending from central portion 22 is a first split body portion 42 and a second split body portion 44. First and second split body portions 42, 44 are complimentary and have opposing surfaces which can be brought into engagement with each other when body portion 42 is folded about living hinge 46 and body portion 44 is folded about living hinge 48. The body portions 42 and 44 can be held in assembly by means of the threaded fasteners 50 which pass through apertures 54 in body portion 44 and threadably engage the walls which define apertures 52 in extensions 56 of body portion 42. The extensions 56 fit within recesses 58 about the apertures 54 in body portion 44 and hold body portions 42 and 44 in assembly until the fasteners 50 are tightened.

The body portions 42 and 44 have end walls 60, 62 respectively, each of which contains a semi-circular aperture 64, 66 respectively, forming a complete electrical cable entrance for the electrical cable whose conductors are connected to conductor contacts 32, 34 and 36. A cable clamping tab 68 extends across body portion 42 and is spaced inwardly from semi-circular aperture 64. A similar clamping tab 72 extends across body portion 44 and is spaced inwardly from semi-circular aperture 66. The free ends 70 and 74 of the clamping tabs 68 and 72, respectively, are curved (See FIG. 1A) to better engage the outer periphery of an electrical cable which enters electric connector assembly 20 (not shown). The spacing between free ends 70 and 74 define the cable diameter range and cannot be altered. Some distortion of a round cable to the oval shape of the space between free ends 70 and 74 is permitted with power cables and some depressions in the cable insulation is permitted without injuring such cables. A slot 78 extends from the inside surface of end wall 60 to a further slot 80 of a lesser length and provides a step 82 at their joinder. Similar slots 84 extends from the inside surface of end wall 62 to a further slot 86 of a lesser length and provides a step 88 at their joinder.

Referring now to FIGS. 4 to 8 and 12, there is shown a removable clamp insert 100 constructed in accordance with the concepts of the invention. A first plate 102 has a rear surface 103 which will face the interior of end walls 60 or 62. In that the removable clamp insert 100 can be used in either split body portion 42 or split body portion 44 in the very same manner, the description hereinafter will be with respect to split body portion 42 and it should be understood that this description applies equally to split body portion 44. The bottom of first plate 102 is tapered as at 104 to facilitate entry into slot 78. Along the top edge are a pair of shoulders 105 having tapered portions 107 to facilitate the assembly of split body portions 42 and 44. A somewhat recessed and curved surface 108 extends between the shoulders 105 and as will be described below engages an electrical cable placed in connector assembly 20. A semicircular projection 110 extends from rear face 103 of plate 102. Projection 110 has a curved surface 112 that fits within and engages semicircular recess 64. The engagement between surface 112 and the walls of recess 64 act as stop means and limit the insertion of the removable clamp insert 100 into split body portion 42. Front surface 109 of plate 102 has a projection 111 extending across a portion of it. Projection 111 is as long as slot 80 and has at least two vertical ribs 113. The ribs 113 engage the back surface of cable clamping tab 68 and with the projection 111 serve to force the rear surface 103 of plate 102 against the interior face of end wall 60 to fix the position of removable clamp insert 100.

Clamp insert 100 has a second plate 116 having a width less than plate 102 and is also shorter. The top portion of plate 116 is defined by a pair of shoulders 118, one at each end, and a curved surface 120 therebetween. Along the bottom portion, plate 116 is relieved as at 117 to fit within slot 71 (or within slot 73 in split body portion 44) with the bottom surface 119 resting against the interior surface of split body portion 42.

Figure 4:
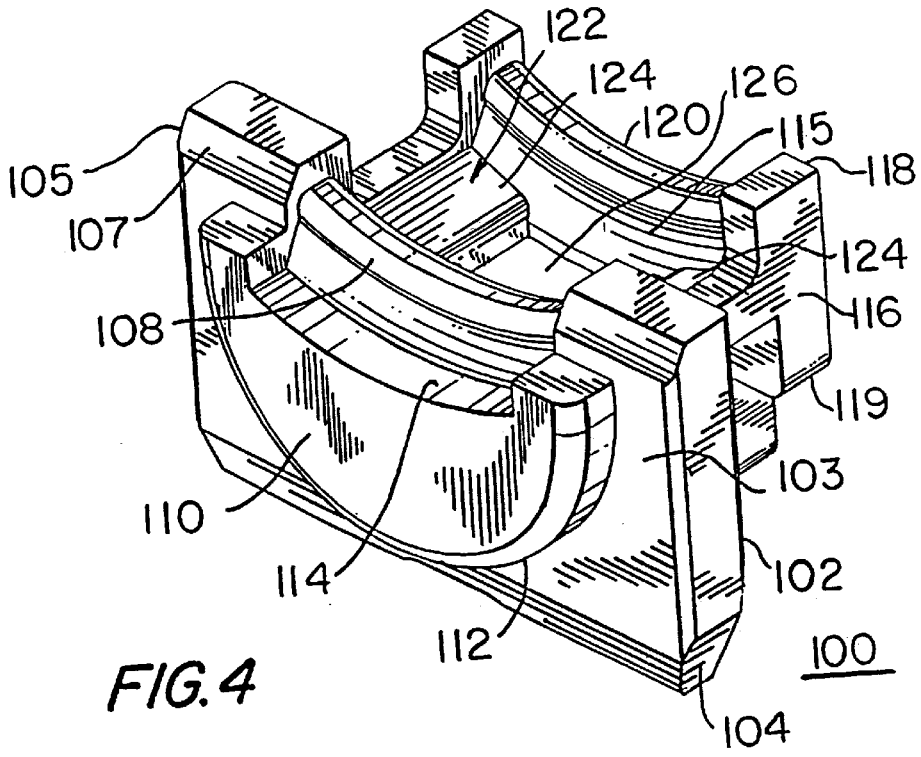
FIG. 4 is a front perspective view of a removable clamp insert according to the concepts of the invention.
Figure 5:
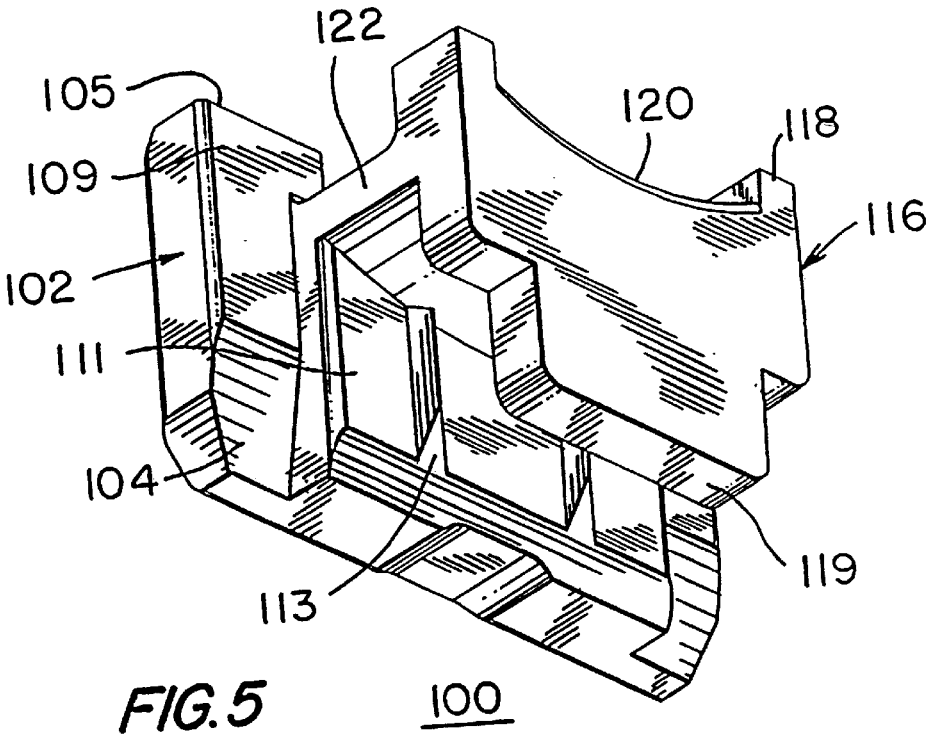
FIG. 5 is a rear perspective view of the removable clamp insert of FIG. 4.
Figure 6:
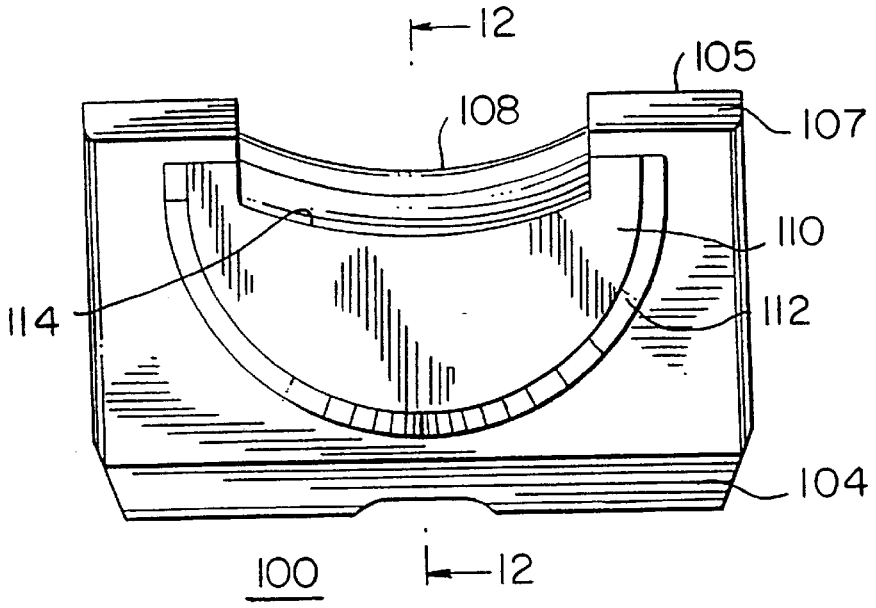
FIG. 6 is a front elevational view of the removable clamp insert of FIG. 4.
Figure 7:
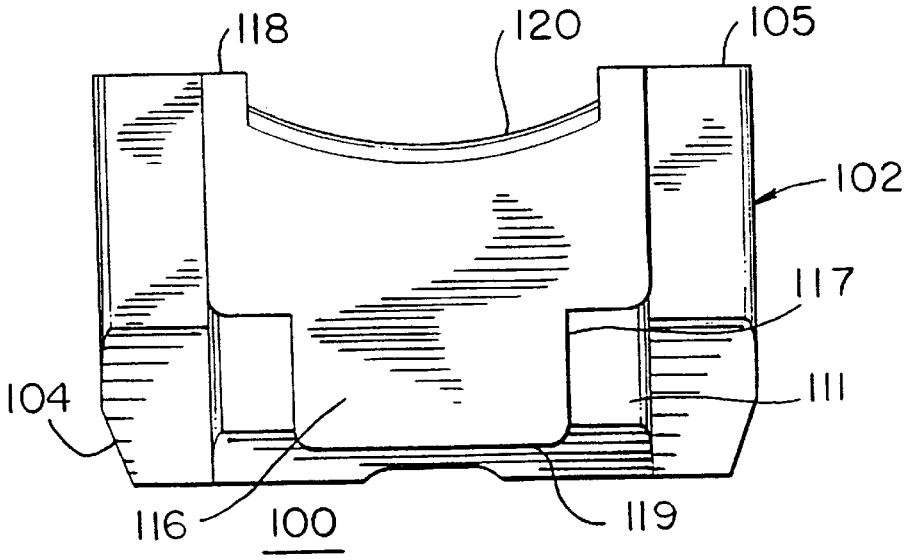
FIG. 7 is a rear elevational view of the removable clamp insert of FIG. 4.
Figure 8:
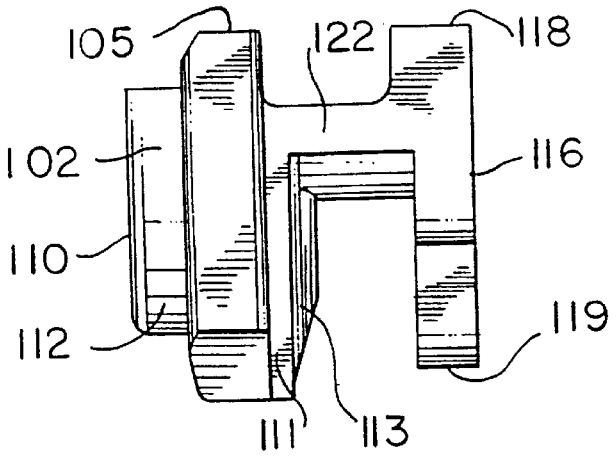
FIG. 8 is a side elevational view of the removable clamp insert of FIG. 4.
Figure 12:
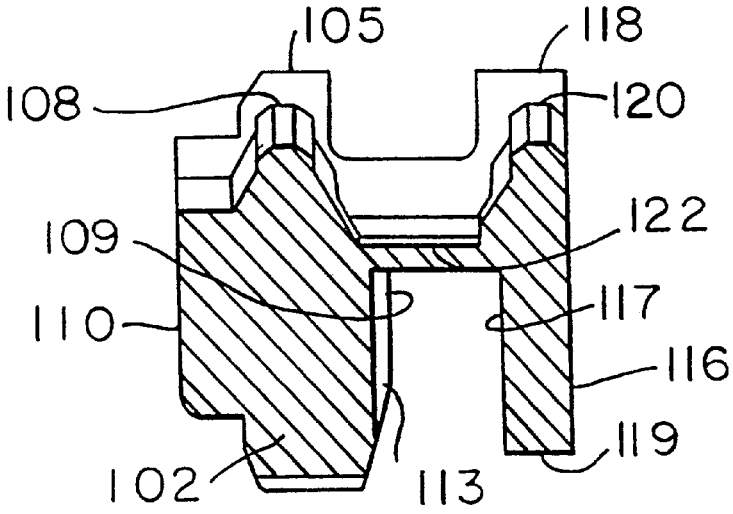
FIG. 12 is a side elevational view, in section, of the removable clamp insert taken along the lines 12—12 in FIG. 6.

As shown in FIGS. 4 and 12, the surfaces 108 and 120 are curved in two dimensions, a first curve extends between the respective end shoulders 105 and 118, respectively, and a second curve front to rear as is shown in FIG. 12. Projection 110 has a relieved region 114 along its top surface to receive the cable extending into the split body portions 42 and 44.

The plates 102 and 116 are connected by a bridge 122 as shown in FIGS. 4 and 12. Bridge 122 extends from the front surface 109 of plate 102 to the front surface 115 of plate 116. Tapered shoulders 124 lead to a well 126 in the center of the bridge 122. The well 126 can receive a portion of the electric cable displaced by the closed strain-relief.

Figure 9:
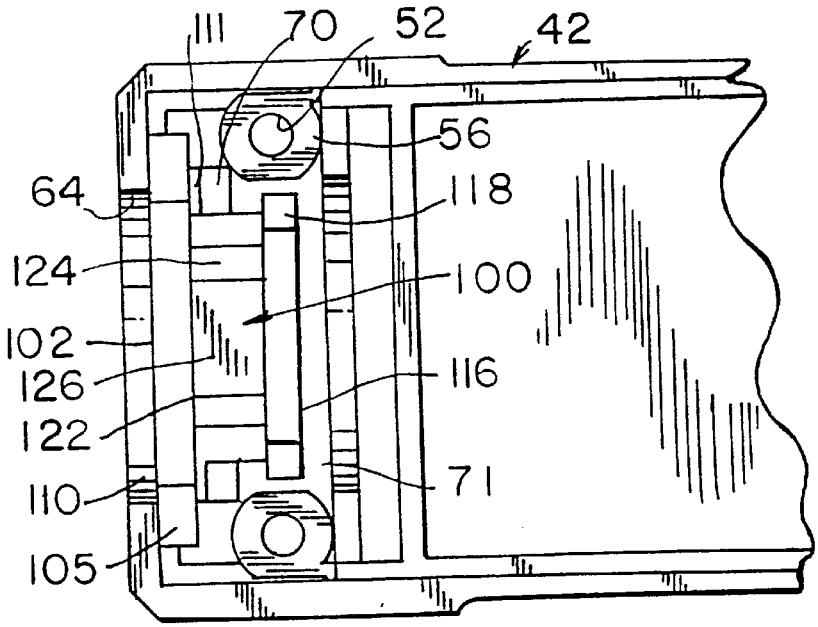
FIG. 9 is a fragmentary top plan view of the removable clamp insert of FIG. 4 installed in the end of the split housing shown in FIG. 2.
Figure 10:
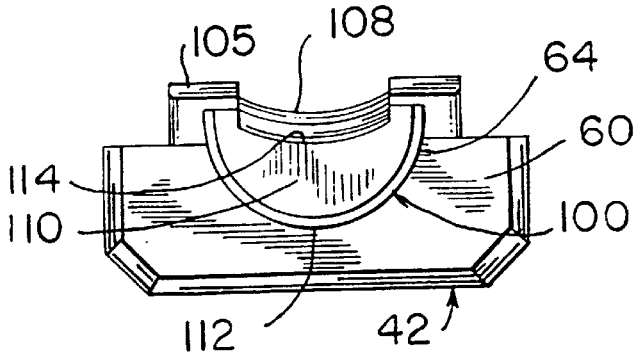
FIG. 10 is a front elevational view of one of the two portions of the split body with a removable clamp insert of FIG. 4 installed.

Referring now to FIGS. 9 and 10 the removable clamp insert 100 is shown installed in split body portion 42. Projection 110 is positioned in semi-circular recess 64 with surface 112 in contact the wall defining recess 64. Plate 102 is positioned in slot 78 while the projection 111 occupies slot 80. Plate 116 is positioned in slot 71. This position leaves the curved surfaces 108 and 120 and the relieved region 114 exposed for engagement with an electrical cable.

Figure 11:
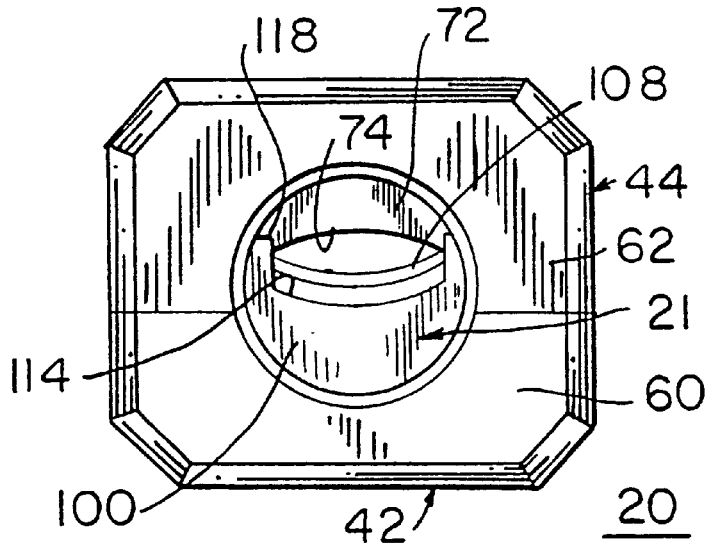
FIG. 11 is a front elevational view of the two portions of the split body closed and having a removable clamp insert of FIG. 4 installed.

FIG. 11 shows a rear view of the closed electrical connector assembly 20 without an electrical cable therein. The clamp insert 100 is positioned in split body portion 42 as was described above with respect to FIGS. 9 and 10. Although only curved surface 108 is shown, it should be remembered that curved surface 120 is aligned with curved surface 108. When split body portion 44 is positioned in assembly with split body portion 42, the clamping tab 72 is positioned in between the plates 102 and 116 and the curved free end 74 along with the curved surfaces 108 and 120 define an oval shaped cable aperture. One of the clamping tabs 68 and 72 and the removable clamp insert 100 together form the strain-relief device 21.

Figure 13:
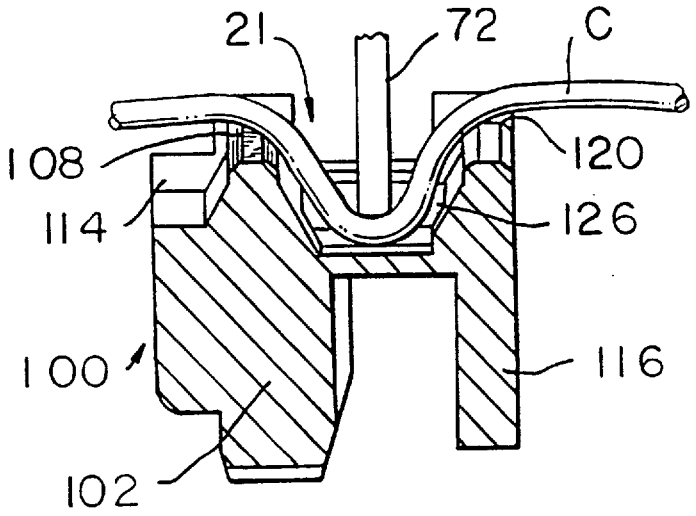
FIG. 13 is a side elevational view, in section, of the removable clamp insert taken along the lines 12—12 in FIG. 6 with the addition of an electrical cable and a clamping tab.
Figure 2:
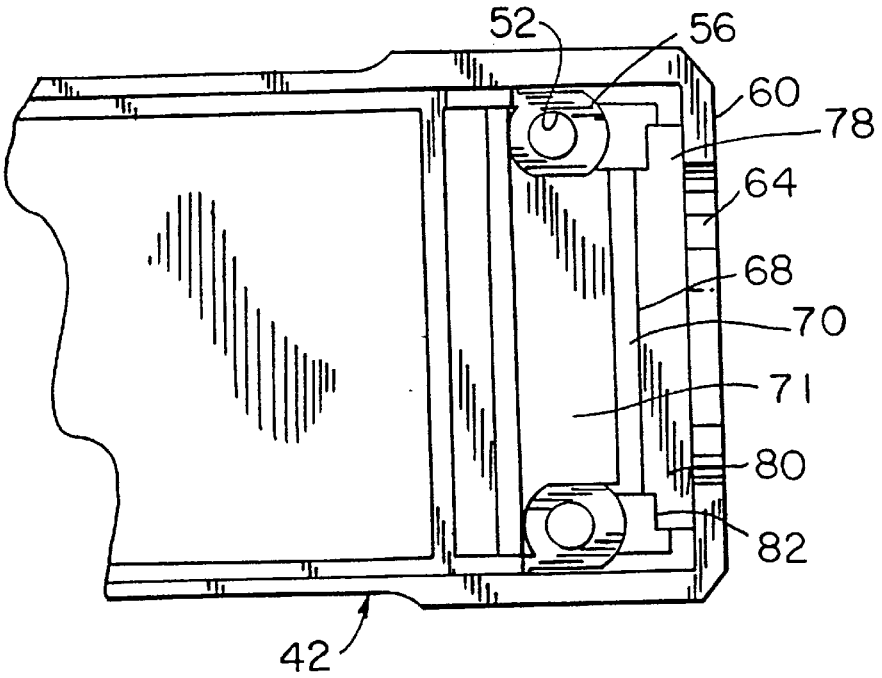
FIG. 2 is a fragmentary top plan view of one end of the split body of FIG. 1.
Figure 3:
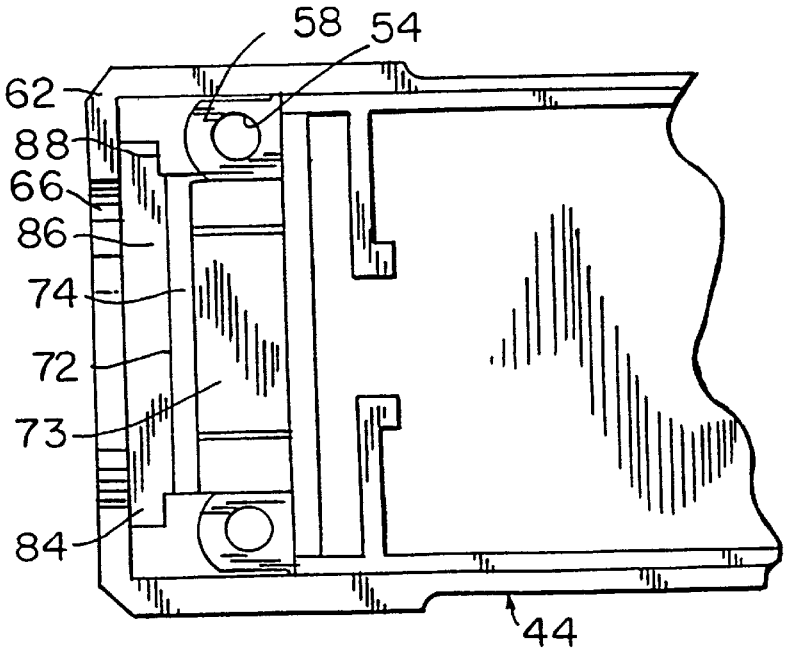
FIG. 3 is a fragmentary top plan view of the other end of the split body of FIG. 1.

FIG. 13 shows how the strain-relief device 21 functions. After the individual conductors of the electrical cable have been terminated to the electrical connector device 24, the electrical cable C is extended over the curved surfaces 108 and 120 of plates 102 and 116 in split body portion 42. The split body portion 44 is then closed upon and fastened to split body portion 42. This assembly step brings the curved free end 74 of clamping tab 72 into contact with the electrical cable C. The pathway between curved surfaces 108 and 120 and the clamping tab 72 will depend upon the thickness of cable C and its construction. Very thin cables C could follow the circuitous route over surface 120, under tab 72 and over surface 108 without distortion. A larger diameter cable C may be distorted from its round shape to a more oval shape similar to the shapes of the surfaces 72, 108 and 120. Larger still cables C may have portions thereof displaced into the well 126 in bridge 122. Relieved area 114 permits a highly compressed cable C to expand as it leaves the strain-relief device 21.

While there has been shown and described and pointed out the fundamental novel features of the invention as applied to the preferred embodiment, as is presently contemplated for carrying it out, it will be understood that various omissions and substitutions and changes of the form and details of the device illustrated and in its operation may be made by those skilled in the art, without departing from the spirit of the invention.

I claim:

1. An electrical connector for attachment to the end of an electrical cable comprising:

a) a split body formed of insulating material;

b) said body being split along a longitudinal axis into two complementary parts and having an opening at a rear end thereof to receive an electrical cable;

c) said two parts of said body having opposing surfaces adapted to be brought into engagement with each other;

d) fastening means located along opposite sides of said body for securing said two parts of said body together;

e) strain relief means carried by and located within said body adjacent the opening in the rear end thereof for engagement with a cable received therein;

f) said strain relief means exerting a clamping force on a cable when said two parts of said body are brought into engagement;

g) said strain relief means comprises two first cable clamping tabs, one formed on each of said two parts of said body adjacent said opening at said rear end thereof, said first cable clamping tabs partially blocking said opening at said rear end;

h) a removable clamp insert capable of being placed in either of said two parts of said body adjacent one of said first clamping tabs in the other of said two parts of said body;

i) said removable clamp insert has a first ridge and a second ridge spaced apart from and parallel with said first ridge and a bridge member therebetween, said bridge member containing a well with tapered shoulders leading into said well from two marginal edges of said bridge;

j) said first ridge has a first curved clamping surface thereon bounded by first shoulders to keep any electrical cable passing over said first ridge from slipping off of said first curved clamping surface;

k) said second ridge has a second curved clamping surface thereon bounded by second shoulders to keep any electrical cable passing over said second ridge from slipping off of said second curved clamping surface;

l) rib means on a front face of said first ridge below said bridge to engage a rear wall of a first cable clamping tab to retain said removable clamp insert in position within one of said two parts of said body; and m) said first cable clamping tab on said one of said two parts of said body not containing said removable clamp insert when said two parts of said body are brought into engagement forces an electrical cable against said first curved clamping surface and said second clamping surface and into said well therebetween to securely grip said cable.

2. An electrical connector, as defined in claim 1, wherein:

a) said first ridge has a projection extending from a rear face of said first ridge, said projection so proportioned and arranged to seat in the opening at the rear end of either of said two parts of said body;

b) said projection has a third curved surface displaced downwardly from said first curved surface as measured from a central longitudinal axis of said body to provide a relief for any cables placed on said removable clamp insert first and second curved clamping surfaces.

3. An electrical connector, as defined in claim 1, wherein each of said two parts of said body contain a slot between an inside surface of a wall defining said rear end of said body and a rear face of said first clamping tab to receive therein said first ridge.

* * * * *